US010313801B2

(12) United States Patent
Park et al.

(10) Patent No.: US 10,313,801 B2
(45) Date of Patent: Jun. 4, 2019

(54) SOUND OUTPUT DEVICE COMPRISES A DUAL SPEAKER INCLUDING A DYNAMIC SPEAKER AND A PIEZOELECTRIC SPEAKER

(71) Applicant: MODA-INNOCHIPS CO., LTD., Ansan-Si, Gyeonggi-Do (KR)

(72) Inventors: Sung Cheol Park, Ansan-Si (KR); Sang Hun Park, Seoul (KR); In Seob Jung, Ansan-Si (KR)

(73) Assignee: MODA-INNOCHIPS CO., LTD. (KR)

( * ) Notice: Subject to any disclaimer, the term of this patent is extended or adjusted under 35 U.S.C. 154(b) by 0 days.

(21) Appl. No.: 15/553,168

(22) PCT Filed: Feb. 23, 2016

(86) PCT No.: PCT/KR2016/001753
§ 371 (c)(1),
(2) Date: Aug. 23, 2017

(87) PCT Pub. No.: WO2016/137200
PCT Pub. Date: Sep. 1, 2016

(65) Prior Publication Data

US 2018/0124522 A1 May 3, 2018

(30) Foreign Application Priority Data

Feb. 24, 2015 (KR) ..... 10-2015-0025853
Sep. 18, 2015 (KR) ..... 10-2015-0132669
Dec. 3, 2015 (KR) ..... 10-2015-0171719

(51) Int. Cl.
*H04R 23/02* (2006.01)
*H04R 17/00* (2006.01)
(Continued)

(52) U.S. Cl.
CPC ..... *H04R 23/02* (2013.01); *H04R 1/025* (2013.01); *H04R 1/24* (2013.01); *H04R 3/14* (2013.01);
(Continued)

(58) Field of Classification Search
CPC ... H04R 1/24; H04R 3/14; H04R 9/06; H04R 9/025; H04R 17/00; H04R 23/02; H04R 1/025; H04R 1/26
See application file for complete search history.

(56) References Cited

U.S. PATENT DOCUMENTS 4,418,248 A * 11/1983 Mathis ..... H04R 1/26 381/190
5,430,803 A * 7/1995 Kimura ..... H04R 1/1016 381/190
(Continued)

FOREIGN PATENT DOCUMENTS

CN 101527873 A 9/2009
CN 204069266 U 12/2014
(Continued)

OTHER PUBLICATIONS

International Search Report for PCT/KR2016/001753 dated May 27, 2016.
Written Opinion for PCT/KR2016/001753 dated May 27, 2016.

*Primary Examiner* — Fan S Tsang
*Assistant Examiner* — Angelica M McKinney
(74) *Attorney, Agent, or Firm* — Renaissance IP Law Group LLP

(57) ABSTRACT

Provided is a sound output apparatus including: a housing having a housing space therein; a first sound output unit provided inside the housing; and a second sound output unit provided in the housing and spaced a predetermined distance from the first sound output unit.

14 Claims, 6 Drawing Sheets

(51) Int. Cl.

| | |
|---|---|
| ***H04R 1/02*** | (2006.01) |
| ***H04R 1/24*** | (2006.01) |
| ***H04R 3/14*** | (2006.01) |
| ***H04R 9/06*** | (2006.01) |
| *H04R 9/02* | (2006.01) |

(52) U.S. Cl.
CPC ..... *H04R 9/06* (2013.01); *H04R 17/00* (2013.01); *H04R 9/025* (2013.01); *H04R 17/005* (2013.01)

(56) References Cited

U.S. PATENT DOCUMENTS

| | | | | |
|---|---|---|---|---|
| 7,567,680 | B2 * | 7/2009 | Murray | H04M 1/03 379/428.01 |
| 2012/0070022 | A1 * | 3/2012 | Saiki | H04R 9/063 381/312 |
| 2012/0155678 | A1 | 6/2012 | Liu et al. | |
| 2014/0064520 | A1 * | 3/2014 | Kim | H04R 17/00 381/120 |
| 2016/0157021 | A1 * | 6/2016 | Ishii | H04R 17/00 381/190 |
| 2016/0183006 | A1 * | 6/2016 | Tokuhisa | H04R 17/005 381/190 |
| 2017/0325014 | A1 * | 11/2017 | Wen | H04R 1/1016 |

FOREIGN PATENT DOCUMENTS

| | | | |
|---|---|---|---|
| JP | 2002291099 | A | 10/2002 |
| JP | 2004147077 | A | 5/2004 |
| JP | 2006129334 | A | 5/2006 |
| JP | 2011049686 | A | 3/2011 |
| JP | 3193281 | U | 9/2014 |
| JP | 3195965 | U | 2/2015 |
| JP | 2015025729 | A | 2/2015 |
| JP | 5768198 | B1 | 8/2015 |
| KR | 100876206 | B1 | 12/2008 |
| KR | 101212705 | B1 | 12/2012 |
| KR | 101381255 | B1 | 4/2014 |
| KR | 20140083860 | A | 7/2014 |
| KR | 200476280 | | 2/2015 |
| TW | 540928 | U | 7/2003 |
| TW | M271332 | U | 7/2005 |
| TW | M493215 | U | 1/2015 |
| WO | 2011050532 | A1 | 5/2011 |

* cited by examiner

SOUND OUTPUT DEVICE COMPRISES A DUAL SPEAKER INCLUDING A DYNAMIC SPEAKER AND A PIEZOELECTRIC SPEAKER

BACKGROUND

The present disclosure relates to a sound output apparatus, and more particularly, to a sound output apparatus capable of enhancing output characteristics in audible frequency bands including low-frequency bands and high-frequency bands.

In general, a piezoelectric device refers to a device having a characteristic capable of mutually changing electrical energy to/from mechanical energy. That is, an electric voltage is generated when a pressure is applied on the piezoelectric device (the piezoelectric effect), and an increase or decrease in volume or length due to an internal pressure change occurs when the electric voltage is applied thereto (the inverse piezoelectric effect). The piezoelectric device is configured with a piezoelectric layer and an electrode provided thereon, and a pressure thereof changes according to the electrical voltage applied to the piezoelectric layer through the electrode.

Various components such as a piezoelectric speaker, a vibration apparatus, or the like may be manufactured using the piezoelectric device. Among these, the piezoelectric speaker is a component which acoustically converts mechanical movements of the piezoelectric device into a sound in desired frequency bands using a vibration plate. It is advantageous that the piezoelectric speaker is thinner and lighter, and smaller in power consumption than an existing dynamic speaker, and thus the piezoelectric speaker can be used in electronic apparatuses such as smart phones which are required to be small, thin, and light-weighted. However, the piezoelectric speaker is disadvantageous in that the piezoelectric speaker delivers strong high-pitched sound and weak low-pitched sound, which causes a user to be unable to listen to music for a long time.

Meanwhile, dynamic speakers are widely used for music playback. The dynamic speakers use the principle that when an audio signal current is applied to a voice coil placed within the magnetic field of a magnet, a mechanical force acts on the voice coil according to the intensity of the current, and thus a movement is caused. However, the dynamic speakers are suitable for implementing low-frequency sound, but are relatively poor for implementing high-frequency sound, and thus the dynamic speakers have limitations in providing high sound quality.

RELATED ART DOCUMENTS

Korea Patent Application Laid-Open Publication No. 2014-0083860

Korea Patent No. 10-1212705

SUMMARY

The present disclosure provides a sound output apparatus capable of having both the advantages of a piezoelectric speaker and the advantages of a dynamic speaker.

The present disclosure also provides a sound output apparatus capable of improving both low-frequency sound characteristics and high-frequency sound characteristics.

In accordance with an exemplary embodiment, a sound output apparatus may include: a housing having a housing space therein; a first sound output unit provided inside the housing; and a second sound output unit provided inside the housing spaced apart by a predetermined distance from the first sound output.

The sound output apparatus may include at least one emission hole formed in a predetermined region of the housing.

The first sound output unit includes a dynamic speaker, and the second sound output unit includes a piezoelectric speaker.

A separation space may be provided between the first and second sound output units, and the emission hole is formed such that at least a portion of the emission hole corresponds to the separation space.

The housing may include a first member, and a second member provided to surround the first member, and the emission hole may be formed in a predetermined region of the second member.

The first member may be provided in a plate shape having a predetermined thickness, and may separate the first and second sound output units from each other.

A stepped portion may be formed on at least one region of one surface of the first member.

The second sound output unit may be provided to contact the stepped portion of the first member, and the first sound output unit may be provided spaced from the other surface opposite to the one surface.

The sound output apparatus may further include at least one protrusion protruding from the inner portion of the second member.

The first member may be provided on an upper portion of the protrusion, and the first sound output unit may be in contact with a lower portion of the protrusion.

The emission hole may be formed to correspond to a space between the first member and the first sound output unit.

The emission hole may be formed to have an area of about 5% to about 90% of the to surface area of the first sound output unit.

The sound output apparatus may further include a coating layer formed on at least a portion of at least one of the first and second sound output units, or the housing.

The first and second sound output units may be driven at the same time by a signal having the same level.

The first and second output units may be driven in a voltage range of about 0.1V to about 5.0V.

The second sound output unit may include a vibration device having an opening, and a piezoelectric device provided on at least one surface over the opening of the vibration device.

A sound output from the second sound output unit may be output through the first sound output unit, and a sound emitted through the emission hole may be mixed outside the housing with the sound output from the first sound output unit.

In accordance with another exemplary embodiment, a sound output apparatus may include: a housing having a housing space therein; a first sound output unit provided inside the housing; a second sound output unit provided inside the housing spaced a predetermined space from the first sound output unit; and a separation member provided between the first and second sound output units inside the housing and to separate the first and second sound output units from each other.

BRIEF DESCRIPTION OF THE DRAWINGS

Exemplary embodiments may be understood in more detail from the following description taken in conjunction with the accompanying drawings, in which.

DETAILED DESCRIPTION OF EMBODIMENTS

Hereinafter, specific embodiments will be described in detail with reference to the accompanying drawings. The present invention may, however, be embodied in different forms and should not be construed as limited to the embodiments set forth herein. Rather, these embodiments are provided so that this disclosure will be thorough and complete, and will fully convey the scope of the present invention to those skilled in the art.

Figure 1:
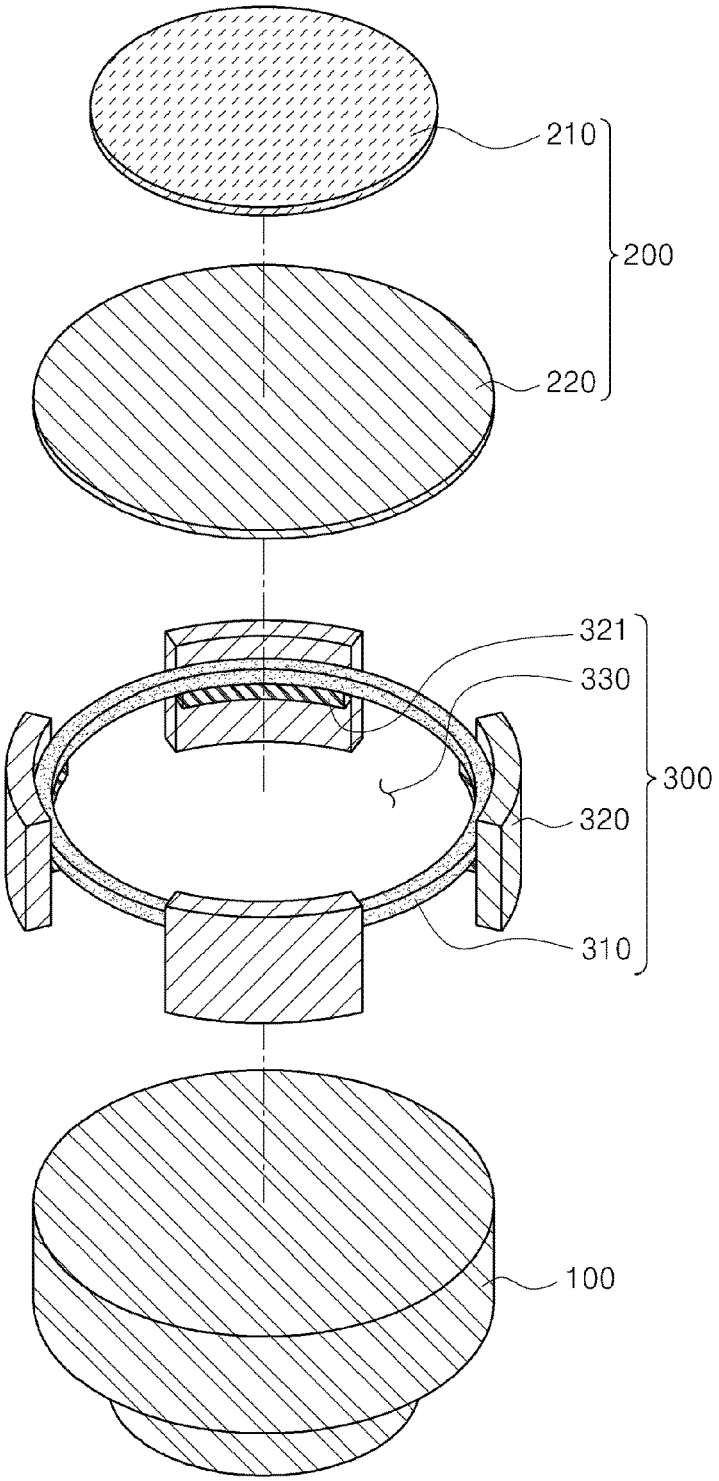
FIG. 1 is an exploded perspective view illustrating a sound output apparatus in accordance with an exemplary embodiment of the present disclosure.
Figure 2:
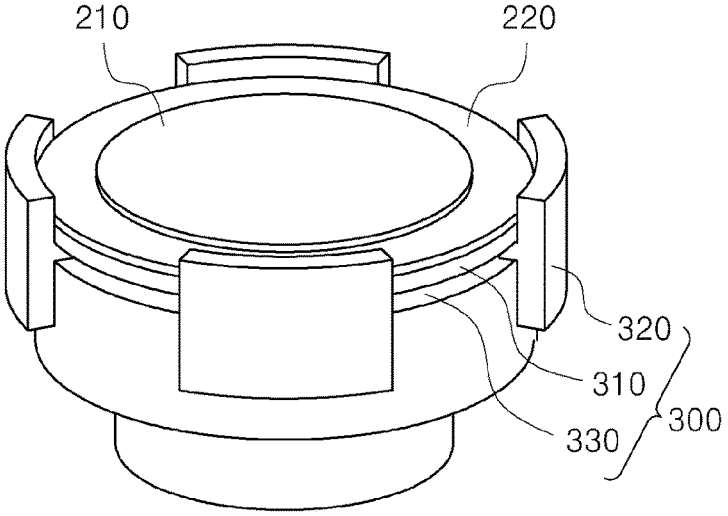
FIG. 2 is a combined perspective view illustrating the sound output apparatus in accordance with the exemplary embodiment of the present disclosure.

FIG. 1 is an exploded view illustrating a sound output apparatus in accordance with an exemplary embodiment of the present disclosure; FIG. 2 is a combined perspective view of the sound output apparatus; and FIG. 3 is a combined cross-sectional view of the sound output apparatus.

Figure 3:
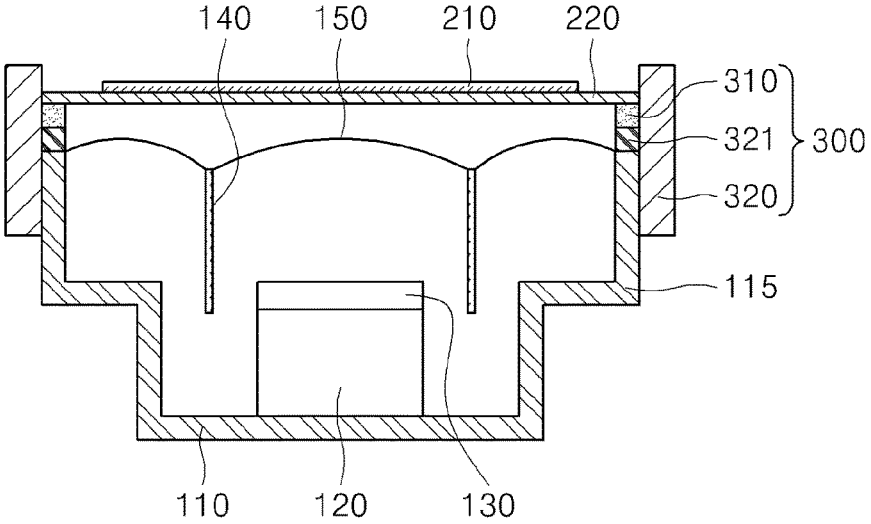
FIG. 3 is a combined cross-sectional view illustrating the sound output apparatus in accordance with the exemplary embodiment of the present disclosure.

Referring to FIGS. 1, 2, and 3, the sound output apparatus in accordance with an exemplary embodiment of the present disclosure may include a first sound output unit 100, a second sound output unit 200 provided on the first sound output unit 100, and a housing 300 for housing the first and second sound output units 100 and 200. That is, the first and second sound output units 100 and 200 may be provided inside the housing 300 such that the first and second sound output units 100 and 200 are spaced apart by a predetermined distance from each other. The first sound output unit 100 may include a dynamic speaker which includes a voice coil 140 and a vibration plate 150, and outputs sound by vibrating the vibration plate 150 using vibration caused by current change in the voice coil 140. Also, the second sound output unit 200 may include a piezoelectric speaker which includes a piezoelectric device 210 and a vibration device 220 and acoustically converts a mechanical movement of the piezoelectric device 210 into a sound by the vibration device 220.

1. First Sound Output Unit

The first sound output unit 100 may be provided in a substantially circular shape having a predetermined thickness. The first sound output unit 100 may include: a yoke 110 and a frame 115 which define a housing space therein; a magnet 120 provided in the housing space inside the yoke 110; a plate 130 provided on the magnet 120; a voice coil 140 spaced from the inner portion of the frame 115 and disposed between the yoke 110 and the magnet 120; and a vibration plate 150 which is provided above the plate 130, an edge of which is fixed to the frame 115, and to which the voice coil 140 is fixed.

The yoke 110 is provided in a substantially cylindrical shape having a predetermined height, and the frame 115 is provided to an upper section of the yoke 110 and has a substantially cylindrical shape having a predetermined height. The height of the frame 115 may be greater than that of the yoke 110, and the width of the frame 115 may be greater than that of the yoke 110. The height of the frame 115 may be equal to or lower than the height of the yoke 110. An upper edge of the frame 115 is in contact with at least a portion of the housing 300, and may be housed in the housing 300. Also, the magnet 120 and the plate 130 are housed inside the yoke 110, the voice coil 140 is housed inside the frame 115, and the vibration plate 150 may be provided on the frame 115 so as to cover the same. The yoke 110 and the frame 115 induce a magnetic field generated by the magnet 120 towards the plate 130 and apply the magnetic force by the magnet 120 to the voice coil 140 to the maximum.

The magnet 120 is fixed to a bottom surface of the yoke 110. That is, the undersurface of the magnet 120 is in contact with and fixed to the bottom surface of the yoke 110. The magnet 120 may be provided in a shape corresponding to the internal shape of the yoke 110. For example, the internal shape of the yoke 110 has a substantially cylindrical bucket shape, and the magnet 120 has a substantially cylindrical shape. The height of the magnet 120 may be the lower than or equal to the height of the yoke 110. Also, the diameter of the magnet 120 may be smaller than the inner diameter of the yoke 110. Thus, the magnet 120 may be provided inside the yoke 110 such that the magnet 120 is spaced apart by a predetermined distance from the inner sidewall of the yoke 110.

The plate 130 is provided on the top surface of the magnet 120. The plate 130 may be provided in a shape similar to the planar shape of the magnet 120. That is, the plate 130 may be provided in a circular plate shape having a predetermined thickness. The plate 130 has a smaller diameter than the inner diameter of the yoke 110, and may have a diameter equal to or larger than the diameter of the magnet 120. Thus, an outer portion of the magnet 120 may be spaced part by a predetermined distance from the inner side surface of the yoke 110. Also, the total height of the magnet 120 and the plate 130 provided on the magnet 120 may be the same as the height of the yoke 110. That is, top portions of the plate 130 and the yoke may be coplanar with each other. The plate 130 allows lines of magnetic force generated by the magnet 120 to be focused towards the voice coil 140.

The voice coil 140 is attached to the undersurface of the vibration plate 150, and may be spaced from the frame 115 and provided between the yoke 110 and the magnet 120. For example, the voice coil 140 is provided between the yoke 110 and the magnet 120 so as to surround the plate 130 and a portion of the magnet 120 with a predetermined height, and has an upper portion attached to the undersurface of the vibration plate 150. The voice coil 140 forms a magnetic field which consistently changes by an electrical signal that is input while consistently changing, and therefore the voice coil 140 vibrates by an interaction due to interference between the magnetic field and another magnetic field formed by the magnet 120.

An edge of the vibration plate 150 is fixed to an inner portion of the frame 115 such that the vibration plate 150 is provided to cover an upper portion of the frame 115. In the vibration plate 150, at least a portion thereof may be convexly provided. For example, the vibration plate 150 may be provided in such a shape that the vibration plate 150 has the highest portion corresponding to a central portion of the plate 115, and a peripheral portion gradually lowered from the center portion to the outside. Also, the voice coil 140 may be fixed to the undersurface the lowest portion of the vibration plate 150.

The first sound output unit 100 constitutes a closed circuit in which the magnetic filed generated from the magnet 120 moves to the yoke 110 positioned at a lower side through the plate 130 provided on the magnet 120, and moves back to the magnet 120. The magnetic field moving into a space between the plate 130 and the yoke 110 thereunder pushes or pulls the voice coil 140 according to a magnetic polarity of the voice coil 140 when the voice coil 140 is magnetized by a current applied thereto. That is, the voice coil 140 is pushed out by a mutual repulsion and moved forward when the voice coil 140 has the same magnetic polarity as the plate 130 and the yoke 110 thereunder, and the voice coil 140 is attracted and pulled back when the voice coil 140 has a different magnetic polarity from the plate 130 and the yoke 110 thereunder. In this way, when the voice coil 140 moves, the vibration plate 150 to which the voice coil 140 is fixed reciprocates and vibrates air, and generates a sound.

2. Second Sound Output Unit

The second sound output unit 200 may include a piezoelectric device 210 and a vibration device 220. The piezoelectric device 210 may be provided, for example, in a circular plate shape having a predetermined thickness. Alternatively, the piezoelectric device 210 may also be provided in various shapes such as a square, a rectangular, an oval, a polygonal shape or the like as well as a circular shape. The piezoelectric device 210 may include a substrate and a piezoelectric layer on which the substrate is formed on at least one surface thereof. For example, the piezoelectric device 210 may be formed as a bimorph type device in which the piezoelectric layers are formed on both sides of the substrate, or formed as a unimorph type device in which the piezoelectric layer is formed on one surface of the substrate. At least one piezoelectric layer may be laminated, and a plurality of piezoelectric layers may be preferably laminated. Also, electrodes may be respectively formed over and below the piezoelectric layer. That is, a plurality of piezoelectric layers and a plurality of electrodes may be alternately laminated to form the piezoelectric device 210. The piezoelectric layer may be formed using for example, PZT (Pb, Zr, Ti), NKN (Na, K, Nb), BNT (Bi, Na, Ti), or a polymer-based piezoelectric material. Also, the piezoelectric layers may be laminated such that the piezoelectric layers are polarized in different or same orientation. That is, when a plurality of piezoelectric layers is formed on the same surface of a substrate, the piezoelectric layers may have polarizations that are alternated in a different or same orientation. Meanwhile, the substrate may use a material having a characteristic that vibration may occur while maintaining a laminated structure of the piezoelectric layers, for example, may be formed of metal, plastics and the like. However, the piezoelectric device 210 may not use the piezoelectric layer or the substrate, for example, the piezoelectric device 210 may be formed in such a configuration that an unpolarized piezoelectric layer is provided in the central portion thereof, and a plurality of piezoelectric layers polarized in different orientations are laminated over and below the unpolarized piezoelectric layer. Meanwhile, an electrode pattern (not illustrated) to which a driving signal is applied may be formed on one surface of the piezoelectric device 210. At least two electrode patterns may be formed spaced apart from each other, and connected with connection terminals (not illustrated), thereby receiving a sound signal from electronic apparatuses, such as auxiliary mobile apparatuses.

The vibration device 220 is provided in a substantially circular shape, and may be bigger than the piezoelectric device 210. Also, the vibration device 220 may have an opening formed in center portion thereof, and the piezoelectric device 210 may be provided over the opening. The piezoelectric device 210 may be bonded to the top surface of the vibration device 220 by adhesives. The vibration device 220 may use a polymer- or pulp-based material. For example, the vibration device 220 may use a resin film such as an ethylene propylene rubber-based material, a styrene butadiene rubber-based material, and the like having a high loss factor, in which Young's modulus is in a range from about 1 MPa to 10 GPa. Also, a lower edge of the vibration device 220 may contact an inner surface of the housing 300. That is, the vibration device 220 and the piezoelectric device 210 bonded to the center portion of the vibration device 220 may be provided inside the housing 300. The second sound output unit 200 is driven by a predetermined signal, and may output a sound having excellent high-frequency sound characteristics.

Meanwhile, a coating layer (not illustrated) may be further formed on at least a portion of the second sound output unit 200. The coating layer may be formed using waterproof materials such as parylene. The parylene may be formed on the upper and side surfaces of the piezoelectric device 210 and the upper and side surfaces of the vibration device 220 exposed by the piezoelectric device 210, in a state in which the piezoelectric device 210 is bonded onto the vibration device 220. That is, the parylene may be formed on the upper and side surfaces of the piezoelectric device 210 and the vibration device 220. Also, the parylene may be formed on the upper and side surfaces of the piezoelectric device 210 and the top, side, and bottom surfaces of the vibration device 220, in a state in which the piezoelectric device 210 is bonded onto the vibration device 220. That is, the parylene may be formed on the top, side, and bottom surfaces of the piezoelectric device 210 and the vibration device 220. When the piezoelectric device 210 is provided over the opening formed in the center portion of the of the vibration device 220, the parylene is formed on the top and side surfaces, and the bottom surface exposed by the opening, and may also be formed on the top, side, and bottom surfaces of the vibration device 220. As such, since the parylene is formed on at least one surface of each of the piezoelectric device 210 and the vibration device 220, moisture penetration into the second sound output unit 200 and a oxidation phenomenon may be prevented. Furthermore, a horizontal vibration caused by use of the vibration device 220 made of a thin material such as polymer may be mitigated, a response speed is enhanced by an increase in hardness of the vibration device 220, and thus an in-depth acoustic characteristic is mitigated, and a high-frequency band sound may be stabilized. Since a resonant frequency may be adjusted in accordance with the coating thickness of the parylene, a sound pressure improvement point may is possibly adjusted. While the parylene may also be coated on the piezoelectric device 210 only, the parylene may be coated on the top, side, and bottom surfaces of the piezoelectric device 210, and may also be coated on an FPCB which is connected to the piezoelectric device 210 for supplying power to the piezoelectric device 210. As the parylene is coated on the piezoelectric device 210, the moisture penetration into the piezoelectric device and the oxidation may be prevented. Also, the resonant frequency may be adjusted by adjusting a forming thickness. Meanwhile, when the parylene is formed on the FPCB, a noise generated by the FPCB and solder, and a device connecting part may also be mitigated. The parylene may be coated in different thicknesses in accordance with materials and characteristics of the piezoelectric device 210 or the vibration device 220. The parylene may be formed thinner than the piezoelectric device 210 or the vibration device 220, and may be, for example, formed in a thickness of about 0.1 μm to about 10 μm. For example, the parylene may be coated on at least one surface of the second sound output unit 200 by vaporizing parylene through a primary heating in a vaporizer to be turned into a dimmer state, then pyrolyzing the resultant into a monomer state through a secondary heating, and converting the resultant into a polymer state from the monomer state by cooling the parylene. Meanwhile, a waterproof layer such as the parylene or the like may also be coated on at least a portion of the first sound output unit 100 and the housing 200 as well as at least on a portion of the second sound output unit 200.

3. Housing

The housing 300 is provided in a substantially cylindrical shape in which at least a portion of a side surface thereof is removed. That is, the housing 300 is provided in a tubular shape vertically opened, and may be provided in the shape in which at least a portion of the side surface is removed. For example, the housing 300 may also be provided as a vertical penetration type one, and also has a shape in which a predetermined inner region is closed and the upper and bottom portions thereof are opened therefrom. The vertical penetration type housing 300 may include a first member 310 having a substantially ring shape having a predetermined thickness, and at least one second member 320 provided in upward and downward direction from a predetermined region of the first member 310. That is, the second member 320 may be provided to surround the ring-shaped first member 310. Alternatively, when the first member 310 is provided in a circular plate shape, the housing 300 may be implemented in a shape in which the upper and lower portions thereof are opened from the first member 310. Also, the second member 320 may be provided outside the first member 310 such that the second member 320 is spaced apart by a predetermined distance from the first member 310. For example, the second member 320 having a predetermined width may be provided in four and the four second members 320 are spaced apart by a predetermined distance from each other. The distance between the second members 320 may be the same as or smaller than the width of the second member 320. For example, the distance between the second members 320 may be about 10% to about 100% of the width of the second member 320. In this exemplary embodiment, the second member 320 is illustrated to have the same thickness as the distance between the second members 320. That is, the second member 320 having a predetermined width may be provided in plurality by being spaced apart by the same distance as the width thereof. Meanwhile, a protrusion 321 may be provided inside the second member 320. That is, the protrusion 321 may be provided to inwardly protrude from an inner wall of the second member 320. Also, the first member 310 may be seated on the protrusion 321. The first and second members 310 and 320 may be manufactured separately and thereafter the first member 310 is seated on the protrusion 321 of the second member 320. Alternatively, the first and second members 310 and 320 may be manufactured integrally. Also, the first and second members 310 and 320 may be manufactured without providing the protrusion 321 such that an outer portion of the first member 310 is attached to be in contact with an inner portion of the second member 320, or manufactured integrally. In the housing 300, the second sound output unit 200, i.e., the vibration device 220 of the piezoelectric speaker, may contact the top surface of the first member 310, and the first sound output unit 100, i.e., a dynamic speaker, may contact a lower portion of the protrusion 321 of the second member 320. That is, the first and second sound output units 100 and 200 may be provided spaced apart by a predetermined distance from each other with the first member 310 and the protrusion 321 disposed therebetween. When the first member 310 is in contact with the inner wall of the second member 320 without the protrusion 321 provided to the inner portion of the second member 320, the vibration device 220 may be in contact with the top surface of the ring-shaped first member 310, the first sound output unit 100 may be in contact with the bottom surface of the first member 310. That is, the first and second sound output units 100 and 200 may be opposed to each other by being spaced apart by the thickness of the first member 210 from each other. Also, the first and second sound output units 100 and 200 are spaced apart by a predetermined distance from each other, and at least a portion of a region between the second members 320 may function as an emission hole 330. That is, the first sound output unit 100 and the first member 310 are spaced apart by a predetermined distance from each other, and the emission hole 330 may be provided to correspond to the space therebetween. The emission hole 330 may be formed in a size of about 5% to about 90% of the top surface area of the first sound output unit 100. That is, the emission hole 330 may be provided by at least one or more, and the whole area of the emission holes 330 may be formed in a size of about 5% to about 90% of the top surface area of the first sound output unit 100, i.e. the area of the vibration plate 150. The size of the emission holes 330 may be preferably formed in a size of about 10% to 60%, and more preferably in a size of about 15% to 30% of the top surface area of the first sound output unit 100. A sound from the first sound output unit 100 is emitted through the emission hole 330. Thus, the sound from the second sound output unit 200 is directly emitted to the outside, and the sound from the first sound output unit 100 is emitted through the emission hole 330 of the housing 300, and thus the two sounds are mixed outside the housing 300 thereby further improving a sound quality. Meanwhile, the sound output apparatus may be manufactured for a speaker for vehicle speakers, in-house speakers, or the like, or as amplifiers and earphones. When the sound output apparatus is manufactured as the earphone such as a kernel-type earphone, the housing 300 may be manufactured in a substantial size that may be inserted in an ear. The earphone may be inserted in an ear from the second output unit 200. Thus, the sound from the second sound output unit 200 is firstly output and the sound from the first sound output unit 100 is later output, so that the two sounds are then mixed inside the ear. Alternatively, the first sound output unit 100 may be firstly inserted in the ear, and the two sounds will also be then mixed inside the ear. Also, according to exemplary embodiments of the present disclosure, the sound output apparatus may be manufactured by inserting the first and second sound output units 100 and 200 in the housing so as to be spaced from each other, or may also be manufactured by combining a portion of the housing 300 in which the first sound output unit 100 is inserted, with another portion of the housing 300 in which the second sound output unit 200 is inserted. For example, the sound output apparatus may be manufactured such that the thickness of the first member 310 is divided in half, the first sound output unit 100 is then inserted inside a first housing with a portion of the second member 320 formed such that the emission hole 330 is formed to surround a first-thickness lower portion of the first member 310, the second sound output unit 200 is then inserted inside a second housing with a portion of the second member 320 formed to surround a second-thickness upper portion of the first member 310, and thereafter the first and second housings are combined. Meanwhile, the sound output apparatus in accordance with the present disclosure can be driven in a low voltage range of about 0.1V to 5.0V, preferably of about 0.1V to about 2.0V, and more preferably of about 0.1V to about 0.5V. Particularly, when the same is applied to the earphones, the sound output apparatus can be driven in a low voltage range of about 0.1V to about 0.2V, and preferably of about 0.1V to about 0.18V. That is, in the piezoelectric device 210 of the second sound output unit 200, a plurality of piezoelectric layers is laminated, and internal electrodes are formed between the respective piezoelectric layers. Here, since the piezoelectric layer is formed in a thickness ranging from about 5 μm to about 20 μm, the second sound output unit 200 can be driven in a low voltage range. While a driving voltage of a typical piezoelectric speaker is 5V or more, the second sound output unit 200 according to the present disclosure can be driven in a low voltage range of about 0.1V to about 0.5V without using an amplifier for piezoelectric speaker, and can thus be driven in a low voltage range in combination with the dynamic speaker. Also, in the sound output apparatus according to the present disclosure, the first and second sound output units 100 and 200 may be driven at the same time by the same signal applied thereto. That is, a signal supplied from a signal source is directly applied to the first sound output unit 100, and applied to the second sound output unit 200 after passing through a high band path filter, and thus low- and high-frequency band signals may be applied to the first and second sound output units 100 and 200 respectively. However, in the present disclosure, a signal having the same level may be applied to the first and second sound output units 100 and 200 at the same time.

Figure 4:
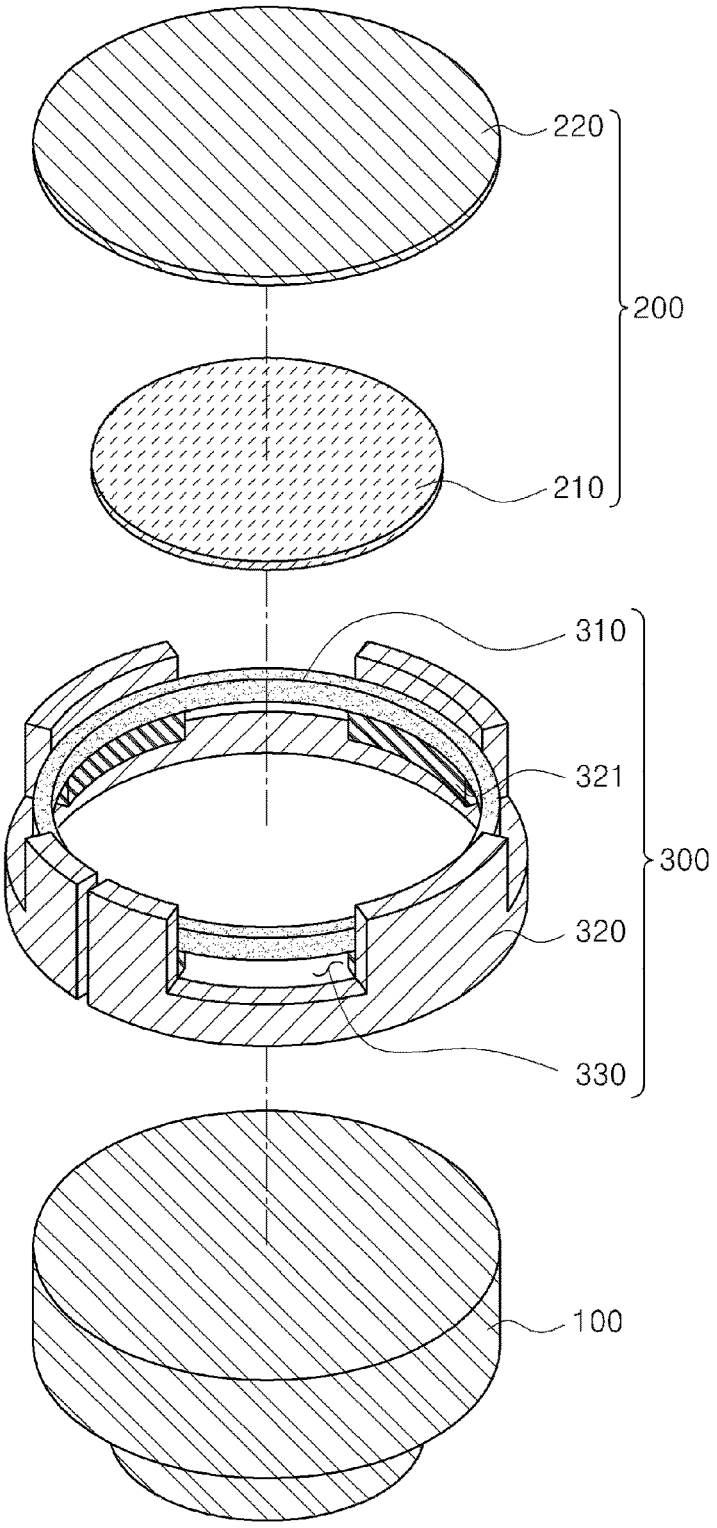
FIG. 4 is an exploded perspective view illustrating a sound output apparatus in accordance with another exemplary embodiment of the present disclosure.
Figure 5:
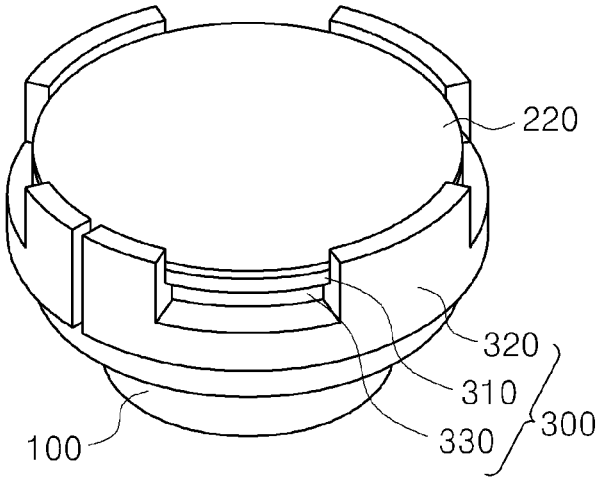
FIG. 5 is a combined perspective view illustrating a sound output apparatus in accordance with another exemplary embodiment and yet another exemplary embodiment of the present disclosure.
Figure 6:
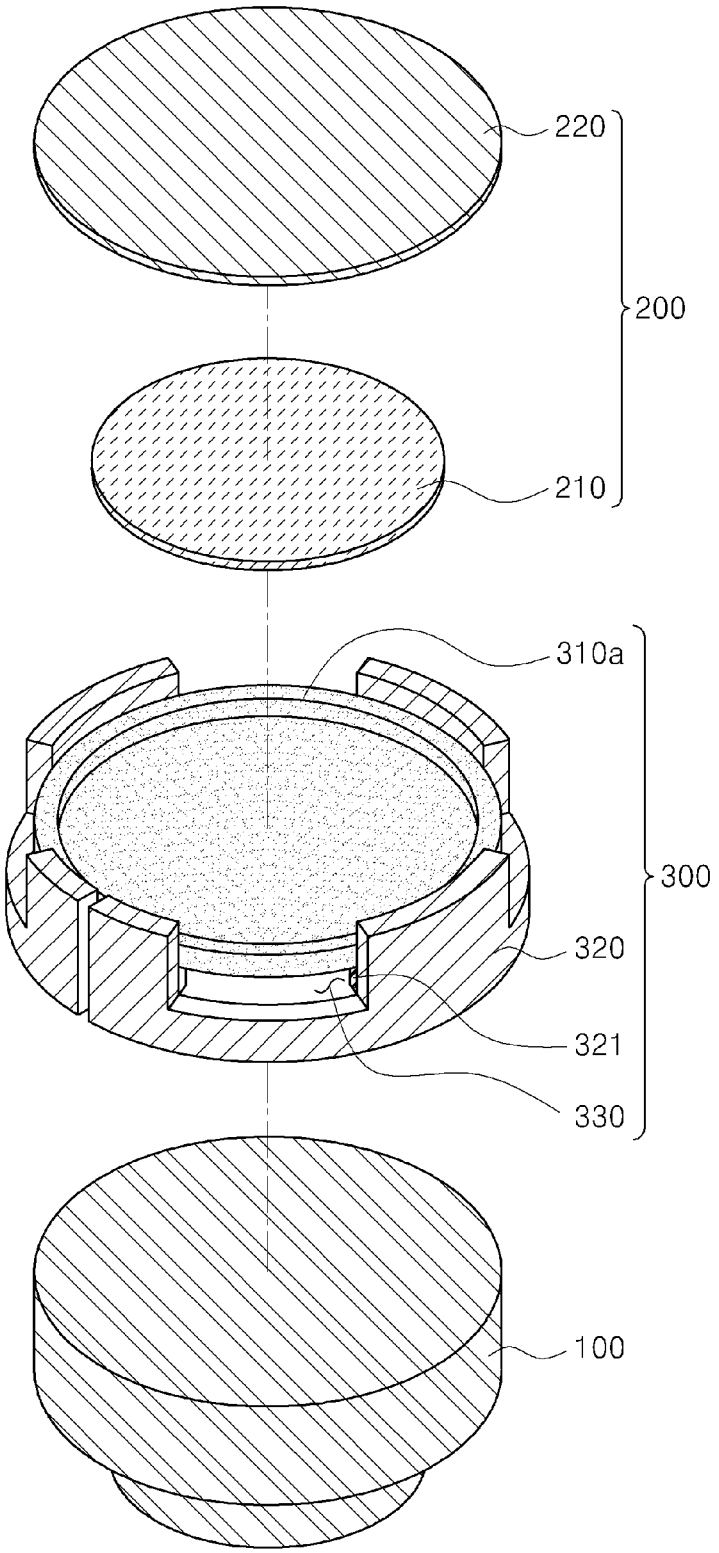
FIG. 6 is an exploded perspective view illustrating the sound output apparatus in accordance with yet another exemplary embodiment of the present disclosure.
Figure 7:
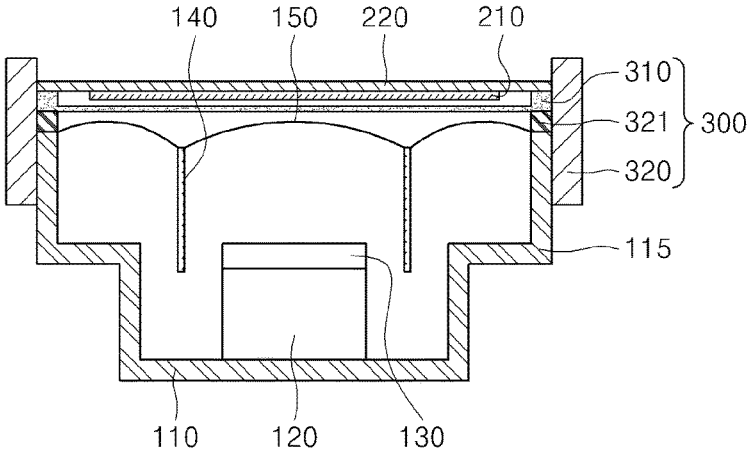
FIG. 7 is a combined cross-sectional view illustrating the sound output apparatus in accordance with yet another exemplary embodiment of the present disclosure.

FIG. 4 is an exploded perspective view illustrating a sound output apparatus in accordance with another exemplary embodiment of the present disclosure, FIG. 5 is a combined perspective view illustrating a sound output apparatus in accordance with another exemplary embodiment and yet another exemplary embodiment of the present disclosure, FIG. 6 is an exploded perspective view illustrating the sound output apparatus in accordance with yet another exemplary embodiment, and FIG. 7 is a combined cross-sectional view illustrating the sound output apparatus in accordance with yet another exemplary embodiment of the present disclosure.

Referring to FIGS. 4 to 7, the sound output apparatus in accordance with another exemplary embodiment and yet another exemplary embodiment of the present disclosure may include: a first sound output unit 100 including a voice coil 140 and a vibration plate 150; a second sound output unit 200 provided on the first sound output unit 100 and including a piezoelectric device 210 and a vibration device 220; and a housing 300 for housing the first and second sound output units 100 and 200. In accordance with another exemplary embodiment and yet another exemplary embodiment of the present disclosure, the second sound output unit 200, i.e. a piezoelectric speaker, may be implemented such that the piezoelectric device 210 is provided under the vibration device 220. Also, an emission hole 330 is formed in a predetermined region of a second member 320 of the housing 300. As illustrated in FIG. 4, a first member 310 may be provided in a ring shape, and as illustrated in FIGS. 6 and 7, a first member 310*a* may be provided in a plate shape. Also, in the plate-shaped first member 310*a*, a height difference may be formed in a predetermined region. For example, a stepped portion may be formed along an upper edge of the first member 310*a*, and thus the height difference may be formed. That is, the first member 310*a* may be formed in a plate shape in which a first region having a predetermined width is formed relatively higher on an edge thereof, and a second region is formed relatively lower than the first region at inner portion of the edge. The first region may be formed in a ring shape along the edge, or may be provided in at least two sub-regions spaced apart from each other. Also, the second region of the first member 310*a* may be provided larger than the piezoelectric device 210. That is, the piezoelectric device 210 may be provided smaller than the vibration device 220 and smaller than the second region such that the piezoelectric device 210 is not in contact with the first region. The vibration device 220 of the second sound output unit 200 is in contact with the stepped portion of the plate-shaped first member 310*a*, i.e., the first region, and a resonant space is provided between the second region of the first member 310*a* and the vibration device 220, so that the piezoelectric device 210 may be disposed therein. Also, since the first member 310*a* is provided in a plate shape, the first member 310*a* separates the first and second sound output units 100 and 200 from each other. That is, the plate-shaped first member 310*a* may serve as a separation member for separating the first and second sound output units 100 and 200. As the first and second sound output units 100 and 200 are separated by the separation member, i.e. the plate-shaped first member 310*a*, sounds output from the first and second sound output units 100 and 200 are output without being mixed together inside the housing 300. Meanwhile, at least one second member 320 in which an emission hole 330 is formed may be provided such that the second member 320 surrounds the ring-shaped first member 310 or the plate-shaped first member 310*a*. For example, the second member 320 is provided singly, and a predetermined region of the second member 320 is cut away in a vertical direction. A signal line for supplying a signal to the second sound output unit 200 may be provided to the cut-away region. The width of the second member 320 in the cut-away region, i.e., the distance between both ends of the second member 320 may be about 1% to about 5% of the width of the second member 320. Also, at least one emission hole 330 is formed in upper portion of the second member 320. The emission holes 330 are provided in, for example four, and the four emission holes 330 may be spaced apart by a predetermined distance from each other at a predetermined height on a lower portion of the first members 310 and 310*a*, and may be formed to the height of the second region of the first sound output unit 100. That is, at least a portion of the second region of the first sound output unit 100 may be exposed by the emission holes 330. Also, the width of the emission hole 330 may be for example, about 20% to about 80%, and preferably about 50% of the width of the second member 320. The area of the emission hole 330 may be about 5% to about 90% of the top space area of the first sound output unit 100, i.e., the area of the vibration plate 150. The size of the emission hole 330 is preferably about 10% to about 60%, and more preferably about 15% to 30% of the top surface area of the first sound output unit 100. Meanwhile, when the first member 310 is formed in a plate shape, the first and second sound output units 100 and 200 may be spatially separated, and the sounds respectively output from the first and second sound output units 100 and 200 may be prevented from being mixed inside the housing 300.

As described above, in the sound output apparatus in accordance with exemplary embodiments of the present disclosure, the first and second sound output units 100 and 200 may be provided inside the housing 300, and output characteristics of both low-frequency and high-frequency sounds may be improved. That is, the first sound output unit 100 having excellent bass characteristics, that is the dynamic speaker, and the second sound output unit 200 having excellent treble characteristics, that is the piezoelectric speaker are provided inside the housing 300, and thus acoustic characteristics in the audible frequency bands may be enhanced. Also, a predetermined separation space is provided between the first and second sound output units 100 and 200 inside the housing 300, and the emission hole 330 is formed in at least a region of the housing 300, and thus the sound output to the separation space from the first sound output unit 100 may be emitted to the outside. That is, since a sound is firstly output from the second sound output unit 200 and a sound is then output from the first sound output unit 100 through the emission hole 330, the two sounds are mixed outside the housing 300. Sound quality may therefore be enhanced because the two sounds are mixed outside the housing 300 when compared to the case in which the two sounds are mixed inside the housing 300.

Figure 8:
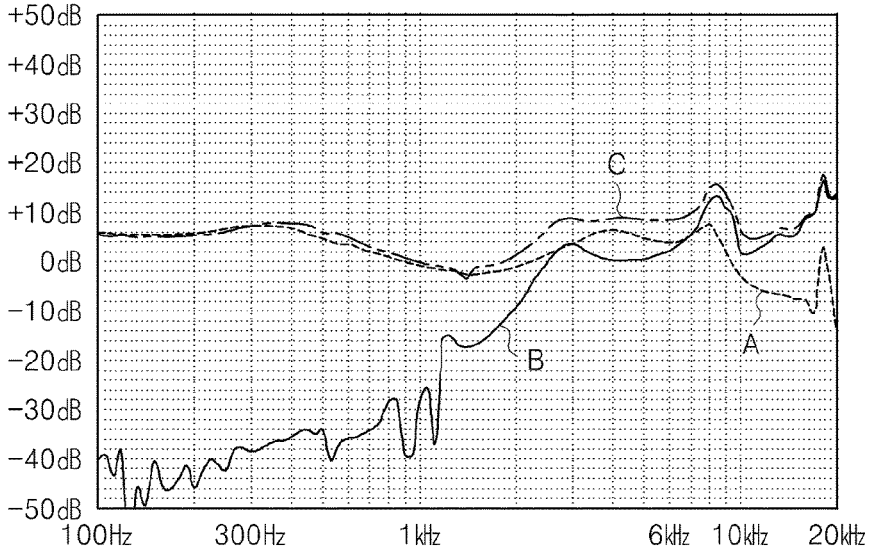
FIG. 8 is a graph showing characteristics of a dynamic speaker, a piezoelectric speaker, and a sound output apparatus in accordance with exemplary embodiments of the present disclosure.

FIG. 8 is a graph showing characteristics of a dynamic speaker, a piezoelectric speaker, and a sound output apparatus in accordance with the present disclosure. A refers to characteristics graph of the dynamic speaker, B refers to characteristics graph of the piezoelectric speaker, and C refers to characteristics graph of the sound output apparatus in accordance with an exemplary embodiment of the present disclosure in which the dynamic speaker and the piezoelectric speaker are combined inside a housing. As illustrated in FIG. 8, the dynamic speaker (A) has excellent characteristics up to about 7 kHz of audio frequency range, that is, excellent the low-frequency sound characteristics, but exhibits a phenomenon in which an attenuation of about 20 dB to 30 dB occurs at audio frequency range higher than 7 kHz when compared with the piezoelectric speaker (B). Thus, the dynamic speaker is proven to be poor in high-frequency sound characteristics. Also, the piezoelectric speaker (B) has excellent characteristics in a mid- and high-frequency band higher than 8 kHz, but exhibits a phenomenon in which the attenuation of about 30 dB or higher occurs at audio frequency range of 3 kHz or lower, which demonstrates that the piezoelectric speaker is poor in low-frequency sound characteristics. However, the sound output apparatus (C) in accordance with an exemplary embodiment of the present disclosure may be figured out that overall acoustic characteristics in the audible frequency band up to 20 kHz are excellent. That is, the sound output apparatus in accordance with the present disclosure may be proven to have similar acoustic characteristics to the dynamic speaker in an audio frequency band up to 1.5 kHz, and better acoustic characteristics than the piezoelectric speaker in the audio frequency band higher than 1.5 kHz. In an audio output apparatus in accordance with exemplary embodiments of the present disclosure, a dynamic speaker and a piezoelectric speaker are spaced a predetermined distance from each other inside a housing. Thus, acoustic characteristics in audible frequency band can be enhanced by disposing, inside a single housing, the dynamic speaker having excellent low-frequency sound characteristics and the piezoelectric speaker having excellent high-frequency sound characteristics. Also, sound quality can be further enhanced by separating the dynamic speaker and the piezoelectric speaker from each other using a separation member provided inside the housing such that the sounds separately output from the dynamic speaker and the piezoelectric speaker are not mixed inside the housing but mixed outside of the housing. Meanwhile, the sound output apparatus in accordance with exemplary embodiments of the present disclosure may be implemented as speakers, earphones, or the like.

Meanwhile, the technical idea of the present invention has been specifically described with respect to the exemplary embodiments, but it should be noted that the foregoing embodiments are provided only for illustration while not limiting the present invention. Further, it will be readily understood by those skilled in the art that various modifications and changes can be made thereto without departing from the spirit and scope of the present invention.

What is claimed is:

1. A sound output device comprising a dual speaker including a dynamic speaker and a piezoelectric speaker comprising:

a housing having a housing space therein;

a dynamic speaker provided inside the housing; and a piezoelectric speaker provided inside the housing and spaced a predetermined distance from the dynamic speaker;

wherein the piezoelectric speaker comprises a plate-shaped piezoelectric device and a plate-shaped vibration device provided on one surface of the piezoelectric device and having the same thickness over the entire area thereof, wherein the housing which comprises a first member and at least one second member surrounding the first member and of which at least a portion surrounds a spaced space between the dynamic speaker and the piezoelectric speaker, wherein the first member has a shape of a plate blocking the dynamic speaker from the piezoelectric speaker to separate the dynamic speaker and the piezoelectric speaker so that sounds emitted from the dynamic speaker and the piezoelectric speaker, respectively, are not mixed; and wherein a sound output from the dynamic speaker is emitted through an emission hole formed in at least a predetermined region of the housing.

2. The sound output device comprising a dual speaker including a dynamic speaker and a piezoelectric speaker of claim 1, wherein a separation space is provided between the dynamic speaker and piezoelectric speaker, and the emission hole is formed such that at least a portion of the emission hole corresponds to the separation space.

3. The sound output device comprising a dual speaker including a dynamic speaker and a piezoelectric speaker of claim 1, wherein a stepped portion is formed on at least one region of one surface of the first member.

4. The sound output device comprising a dual speaker including a dynamic speaker and a piezoelectric speaker of claim 3, wherein the piezoelectric speaker contacts the stepped portion of the first member, and the dynamic speaker is spaced from the other surface opposite to the one surface.

5. The sound output device comprising a dual speaker including a dynamic speaker and a piezoelectric speaker of claim 4, further comprising at least one protrusion protruding from the inner portion of the second member.

6. The sound output device comprising a dual speaker including a dynamic speaker and a piezoelectric speaker of claim 5, wherein the first member is provided on an upper portion of the protrusion, and the dynamic speaker is in contact with a lower portion of the protrusion.

7. The sound output device comprising a dual speaker including a dynamic speaker and a piezoelectric speaker of claim 6, wherein the emission hole is formed to correspond to a space between the first member and the dynamic speaker.

8. The sound output device comprising a dual speaker including a dynamic speaker and a piezoelectric speaker of claim 7, wherein the emission hole is formed to have an area of about 5% to about 90% of the top surface area of the dynamic speaker.

9. The sound output device comprising a dual speaker including a dynamic speaker and a piezoelectric speaker of claim 8, further comprising a coating layer formed on at least a portion of at least one of the dynamic speaker and piezoelectric speaker, or the housing.

10. The sound output device comprising a dual speaker including a dynamic speaker and a piezoelectric speaker of claim 9, wherein the dynamic speaker and piezoelectric speaker are driven at the same time by a signal having the same level.

11. The sound output device comprising a dual speaker including a dynamic speaker and a piezoelectric speaker of claim 10, wherein the dynamic speaker and piezoelectric speaker are driven in a voltage range of about 0.1V to about 5.0V.

12. The sound output device comprising a dual speaker including a dynamic speaker and a piezoelectric speaker of claim 11, wherein the piezoelectric speaker comprises a vibration device having an opening, and a piezoelectric device provided on at least one surface over the opening of the vibration device.

13. The sound output device comprising a dual speaker including a dynamic speaker and a piezoelectric speaker of claim 1, wherein a sound output from the piezoelectric speaker is output through the dynamic speaker, and emitted through the emission hole are mixed outside the housing.

14. A sound output device comprising a dual speaker including a dynamic speaker and a piezoelectric speaker comprising:

a housing having a housing space therein;

a dynamic speaker provided inside the housing;

a piezoelectric speaker provided inside the housing and spaced a predetermined space from the dynamic speaker; and a separation member provided between the dynamic speaker and piezoelectric speaker inside the housing to separate the dynamic speaker and piezoelectric speaker from each other; and at least one emission hole formed at a predetermined region of the housing, wherein the piezoelectric speaker comprises a plate-shaped piezoelectric device and a plate-shaped vibration device provided on one surface of the piezoelectric device and having the same thickness over the entire area thereof, wherein the housing has at least a portion surrounding a spaced space between the dynamic speaker and the piezoelectric speaker, wherein the separation member having a plate shape is provided between the dynamic speaker and the piezoelectric speaker to separate the dynamic speaker and the piezoelectric speaker so that sounds emitted from the dynamic speaker and the piezoelectric speaker, respectively, are not mixed, wherein the emission hole is defined in a region corresponding to a spaced space between the dynamic speaker and the separation member, and wherein a sound output from the dynamic speaker is emitted through the emission hole.

* * * * *